United States Patent [19]

Schmidt, III et al.

[11] 3,954,240

[45] May 4, 1976

[54] SUPPORT FOR INFANT'S NURSING BOTTLE

[76] Inventors: Lorentz Schmidt, III; Diane Elizabeth Schmidt, both of R.F.D. 2, Box 135, 134 Sunswept Lane, High Ridge, Mo. 63049

[22] Filed: June 12, 1974

[21] Appl. No.: 478,507

[52] U.S. Cl. ..... 248/104

[51] Int. Cl.[2] ..... A47D 15/00

[58] Field of Search ..... 248/102, 103, 104, 105, 248/317, 318, 327; 211/119, 113, 117

[56] References Cited

UNITED STATES PATENTS

| | | | |
|---|---|---|---|
| 1,030,744 | 6/1912 | Neumann | 248/102 |
| 1,634,162 | 6/1927 | Tesk | 248/102 X |
| 1,692,098 | 11/1928 | Sullivan | 248/104 |
| 1,750,672 | 3/1930 | Krischer | 248/102 UX |
| 1,867,992 | 7/1932 | Sullivan | 248/104 |
| 2,448,189 | 8/1948 | Mott | 248/104 |
| 2,457,972 | 1/1949 | Bailey | 248/103 |
| 2,638,296 | 5/1953 | Battle | 248/105 |
| 3,161,392 | 12/1964 | Kopec et al. | 248/104 |
| 3,539,140 | 11/1970 | Tuttle | 248/104 |

FOREIGN PATENTS OR APPLICATIONS

| | | | |
|---|---|---|---|
| 2,063,053 | 7/1971 | Germany | 248/327 |
| 476,390 | 8/1951 | Canada | 248/102 |

*Primary Examiner*—Roy D. Frazier
*Assistant Examiner*—Robert W. Gibson, Jr.
*Attorney, Agent, or Firm*—F. Travers Burgess

[57] ABSTRACT

A hanger is provided for supporting an infant nursing bottle from the top crossbar of an infant swing, the hanger comprising an elongated member with a hook at its upper end for support on the swing crossbar and a loop at its lower end to grip the bottle and maintain it in a substantially horizontal position directed toward the location of the infant's mouth.

2 Claims, 5 Drawing Figures

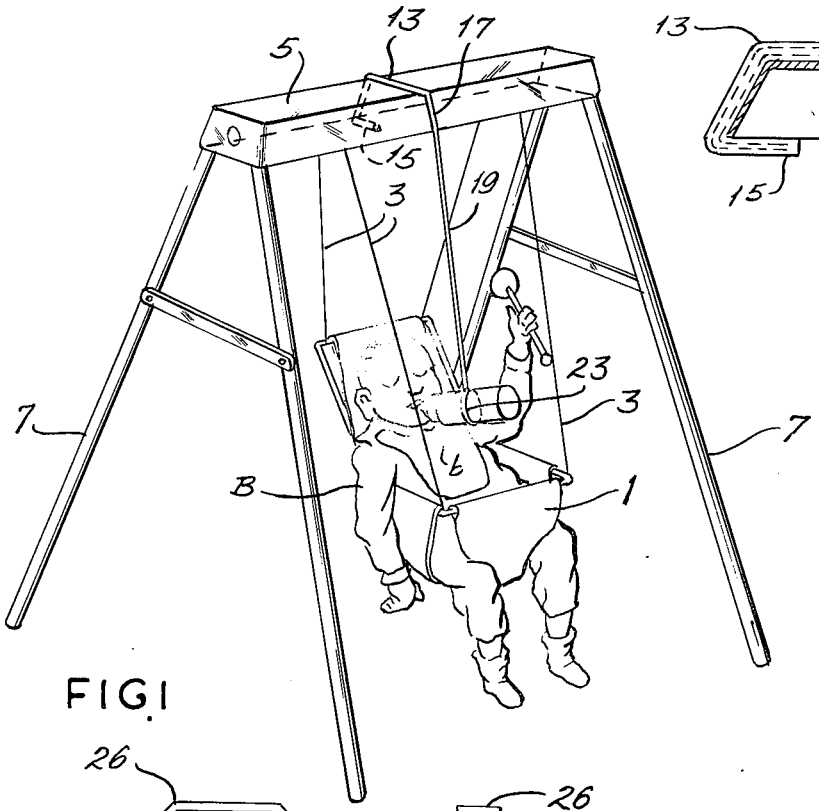
FIG. 1
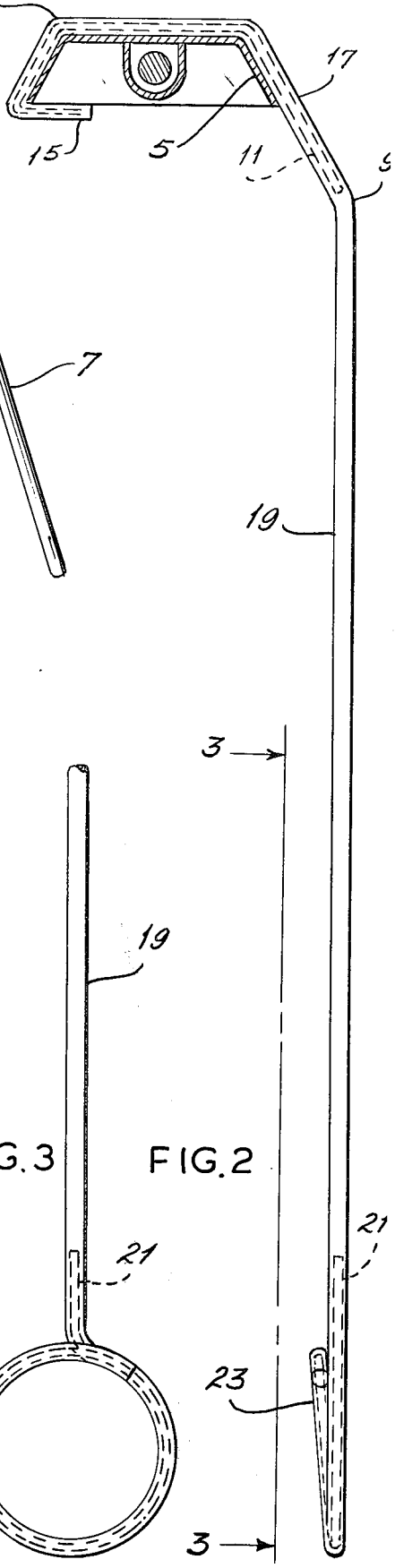
FIG. 2
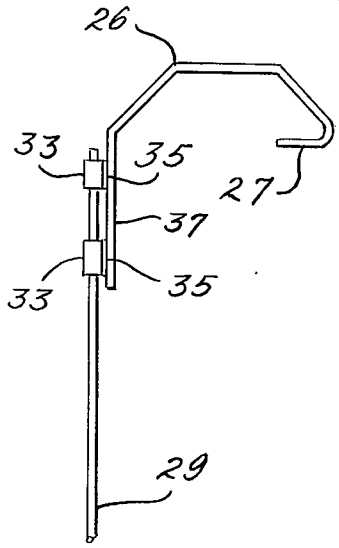
FIG. 4
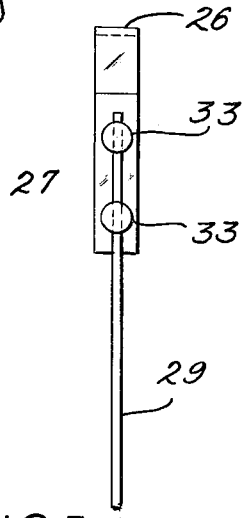
FIG. 5
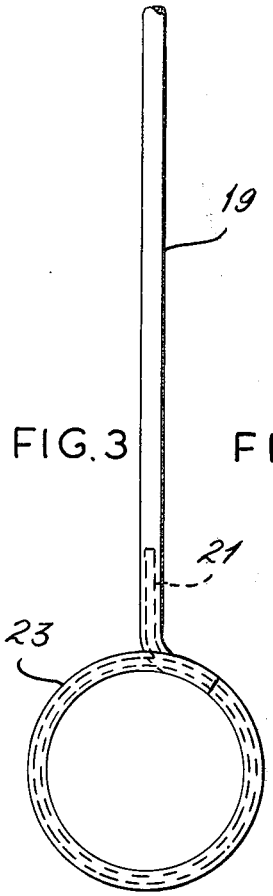
FIG. 3
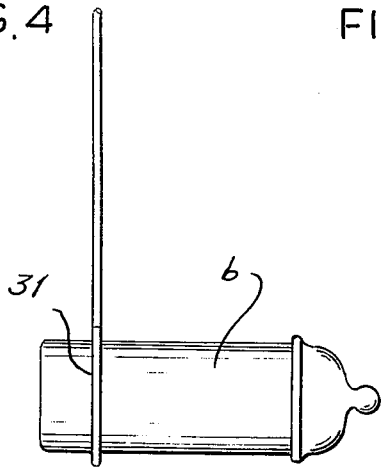
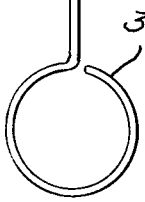

SUPPORT FOR INFANT'S NURSING BOTTLE

BACKGROUND OF THE INVENTION

1. Field of the Invention

The invention relates to nursing bottle supports and consists particularly in a hanger for supporting nursing bottles from infant swing support structures.

2. The Prior Art

The prior art known to applicant discloses no means for supporting a nursing bottle from an infant swing support structure or the like.

SUMMARY OF THE INVENTION

The invention provides a simple, inexpensive, yet effective holder for supporting an infant nursing bottle from an infant swing support structure.

Objects of the invention include provisions for holding the bottle nearly horizontal to permit the infant to nurse in a seated position, adjustability to accommodate any size and shape of nursing bottle, use of the bottle-holding loop, when empty, as a teething ring or an exerciser (in which the infant grasps the ring and pulls on it), or an eye exercisor (in which the infant hits the ring and then must move his eyes to watch it swing).

The invention also eliminates the necessity of the mother or father repeatedly picking up a bottle, which most infants drop or throw several times during one feeding when learning to hold. If the bottle is lost from the infant's mouth, with the present invention, a mere turn of the infant's head will restore it with no help from parents.

Flexibility of the support enables the infant to turn its head to look from side to side while nursing without losing the bottle.

Adjustability of the bottle-holding loop makes it possible to adjust the angle of the bottle, thus keeping air passage to a minimum.

BRIEF DESCRIPTION OF THE DRAWINGS

FIG. 1 is a perspective view of an infant swing to which a nursing bottle support constructed according to the invention is applied.

FIG. 2 is a side elevational view of the support.

FIG. 3 is a frontal elevational view of the support.

FIG. 4 is a side elevational view of a modified form of support.

FIG. 5 is a front view of the support illustrated in FIG. 4.

DETAILED DESCRIPTION OF THE INVENTION

The numeral 1 denotes an infant swing seat swingably suspended by cords 3 from the top crossbar 5 of a swing support structure having foldable A-frames 7 connected at their apices to crossbar 5.

Top bar 5 may be of generally trapezoidal cross section, or of any suitable cross sectional shape and size, and of itself does not form part of the present invention.

The nursing bottle support according to the invention comprises an elongated member 9 constructed of flexible tubing of plastic, elastomeric or other nonmetallic material. At its upper end a stiffener 11, which may comprise a length of metallic wire, is inserted in the tubing and is bent to form a hook 13 corresponding in shape to the exterior cross-sectional shape of swing frame crossbar 5, and has its terminal 15 rebent to underlie the rear margin of crossbar 5 and thereby secure hook 13 to crossbar 5.

The forward leg 17 of hook 13 may be relatively long to provide a desirable offset of the shank portion 19 of the bottle support forward of crossbar 5 and hence in front of the face of an infant B seated in swing seat 1.

At its lower end, in the region of the level of infant B's mouth, a second stiffener 21 is inserted in tubular member 9 and is curved to form a loop 23 lying in a substantially vertical plane perpendicular to the plane of hook 13.

Wires 15 and 21, though fairly stiff, are sufficiently flexible to permit their being bent, respectively to form hook shapes usable with different crossbar cross sections and loops of different sizes and shapes and of different inclinations to grip various sizes and shapes of nursing bottles *b* and hold them at selected inclinations.

In the embodiment of the invention shown in FIGS. 4 and 5, a hook portion 26 is formed of a flat metal strip bent to correspond to the cross-sectional contour of crossbar 5 and rebent at its end to form a terminal 27 underlying the rear margin of the crossbar to retain the hook on the crossbar. The shank 29 and loop 31 are formed from a length of relatively stiff but slightly resilient wire, to the upper end portion of which are secured a pair of snap fastener parts 33 spaced apart lengthwise of the wire and arranged for detachable engagement with mating snap fastener parts 35 on a vertically depending portion 37 of hook element 26. With this arrangement, when the support is not in use, the hook portion can be left mounted on the swing support frame crossbar and the shank with loop can be removed simply by loosening snap fasteners 33, 35.

The details of the bottle support may be varied substantially without departing from the spirit of the invention and the exclusive use of such modifications as come within the scope of the appended claims is contemplated.

We claim:

1. A support for a nursing bottle for use by an infant comprising an elongated member having a hook-like element at its upper end, a bottle-gripping loop at its lower end, and an intermediate elongated portion sufficiently stiff to maintain the bottle in a substantially horizontal position and sufficiently flexible to accommodate substantial movements of the infant's head without loss of the bottle from the infant's mouth, the plane of said loop being substantially vertical and substantially perpendicular to the plane of said hook-like element, said hook-like element being formed for close-fitting immovable engagement with external structure located above the infant's head, a continuous length of nonmetallic flexible tubing forming said hook-like element, said intermediate portion and said loop, and stiffeners in the respective ends of said length of flexible tubing shaped to form said hook-like element and said loop.

2. A support structure according to claim 1 wherein said stiffeners comprise lengths of metallic wire bent to the shape of said hook-like element and said loop.

* * * * *